US005101222A

United States Patent [19]

Hakkaku

[11] Patent Number: 5,101,222

[45] Date of Patent: Mar. 31, 1992

[54] IMAGE RECORDING APPARATUS FOR TWO-SIDED THERMAL RECORDING

[75] Inventor: Kunio Hakkaku, Kanagawa, Japan

[73] Assignee: Fuji Photo Film Co., Ltd., Kanagawa, Japan

[21] Appl. No.: 486,677

[22] Filed: Feb. 28, 1990

[30] Foreign Application Priority Data

Mar. 6, 1989 [JP] Japan ..... 1-53275

[51] Int. Cl.[5] ..... B41J 2/32; B41M 5/34

[52] U.S. Cl. ..... 346/76 PH; 400/120; 400/188

[58] Field of Search ..... 346/76 PH, 134, 135.1; 400/120, 120 MP, 120 MC, 188; 355/318, 319

[56] References Cited

U.S. PATENT DOCUMENTS 4,590,490 5/1986 Taranashi et al. ..... 346/76 PH
4,857,941 8/1989 Kaida ..... 346/76 PH
4,940,993 7/1990 Sato ..... 346/76 PH
4,962,386 10/1990 Hakkaku ..... 346/76 PH

FOREIGN PATENT DOCUMENTS 40-20151 9/1965 Japan .
50-3640 1/1973 Japan .
49-114431 10/1974 Japan .
60-4092 1/1985 Japan .
61-227086 10/1986 Japan .
62-44492 2/1987 Japan .
63-45084 2/1988 Japan .
0110465 5/1988 Japan ..... 355/319
63-252783 10/1988 Japan .

*Primary Examiner*—Benjamin R. Fuller
*Assistant Examiner*—Huan Tran
*Attorney, Agent, or Firm*—Sughrue, Mion, Zinn, Macpeak & Seas

[57] ABSTRACT

An image recording apparatus in which the thermal recording material has a transparent support which is provided with a plurality of transparent thermal color-developing layers. The transparent thermal color-developing layers are successively heated and developed in their respective colors while the thermal recording material is transported, to recording an image onto the thermal record material. The image recording apparatus contains a setting unit for judging the position at which the image is to be recorded, to set heating timing. Accordingly, it is possible to cause the color-developed positions of the respective transparent color-developing layers on the thermal recording material to be in agreement with each other.

18 Claims, 11 Drawing Sheets

IMAGE RECORDING APPARATUS FOR TWO-SIDED THERMAL RECORDING

BACKGROUND OF THE INVENTION

1. Field of the Invention

The present invention relates to an image recording apparatus for recording an image onto a thermal recording material including a transparent support and a plurality of transparent thermal color-developing layers which are respectively developed in different hues and are provided on both sides of the transparent support. 2. Description of the Prior Art At present, there is known a thermal recording method for recording an image onto a recording paper by the use of a heating element. In this thermal recording method, a thermal recording material is used which is coated with a color-developing agent and a developer on a support such as paper, synthetic paper or the like. An image is recorded onto the thermal recording material by a thermal head on the basis of a process in which the thermal recording material is heat-processed. Such a thermal recording method has the following advantages, i) development is unnecessary, ii) in case where the support is paper, the paper quality is approximates that of generally used paper, iii) handling is easy, iv) the density of color development is high, v) The recording device is simple and of low cost, and vi) noise at the time of recording is less than that of a dot printer or the like. Thus, this thermal recording method has rapidly spread in recent years in the field of black-and-white facsimiles and printers.

Further, accompanying the rapid expansion and developments in the information industry, the demand for color hard copies from general terminal equipment, including computers and facsimiles has increased. In order to obtain multi-color thermal recording material, however, it is required that color-developing mechanisms corresponding in number to the developed colors be incorporated on the same support, and be controllable. In spite of the fact that a great deal of effort has been made, the hues of color development and color separation have not been satisfactory.

An opaque support such as paper, synthetic paper or the like is normally used as a support for the thermal recording material. This is merely due to the fact that a color-developing image is read as a reflective image from one side of the support.

Further, examples in which a transparent support is used as a support for thermal recording material, are disclosed in Japanese Patent Publication No. SHO 40-20151 and Japanese Patent Application Laid-Open Nos. SHO 61-227086 and SHO 62-44492, whose purposes are such that a thermally recorded recording image is viewed from one side of the transparent support to thereby obtain a high-contrast image or a high-quality image superior in luster or gloss. Further, it has also been proposed in Japanese Patent Application Laid-Open Nos. SHO 49-114431, SHO 50-3640 and SHO 60-4092 that thermal recording layers different in color-developing hue from each other are provided on both sides of the transparent support member, to obtain a color image having two colors or a plurality of colors.

However, in these cases each of the thermal color-developing layers includes color-developing components and developer components merely dispersed in a solid condition. Accordingly, the thermal color-developing layer per se is made substantially opaque due to diffuision of light. Thus, it is impossible to obtain a clearly color-divided multi-color image. In the invention disclosed in the aforesaid Japanese Patent Application Laid-Open No. SHO 60-4092, in order to improve transparency of the thermal color-developing layer, various components are dissolved and are coated onto the same layer. In this case, however, since color development in the various components is easily caused to occur before printing, a so-called fog or blushing occurs. Accordingly, the possible or potential numbers of color division are lowered and the material disclosed in the above Japanese provisional publication is essentially insufficient as a multi-color recording material.

In Japanese Patent Application Laid-Open Nos. SHO 63-45084 and SHO 63-252783, the applicant has proposed that color-developing layers, which are substantially transparent and are developed in color to hues different from each other, are provided on both sides of a transparent support, whereby it is possible to obtain a thermal color-developing image which is superior to the conventional one.

According to the proposal, it is possible to obtain a multi-color image which is superior in hue, superior in color separation, and superior in image reservation, than is conventionally obtained by the thermal recording system. Further, the obtained image can be image transparent image, reflective.

Since such thermal recording paper is provided at both sides with color-developing layers, it is required that both sides be heated respectively by thermal heads. Further, in the case were a plurality of color-developing layers are provided on one side of the thermal recording material, it is required that the uppermost layer, that is, a layer most proximate to the surface of the support, be heat-developed by a heat quantity of an order such that the other layers are not heated, and the color-developing layer is then fixed before heat-processing the other color-developing layers. A principal or basic image recording process or procedure will be described hereunder with reference to FIG. 4 of the accompanying drawings.

As shown in FIG. 4(A), a thermal recording material 10 comprises a polyester film (hereinafter referred to as "PET") 102 which serves as a support for the thermal recording material 10. A magenta-pigment layer (hereinafter referred to as "M-pigment layer") 104 is provided on one side of the PET 102. An yellow-pigment layer (hereinafter referred to as "Y-pigment layer") 106 is provided on the M-pigment layer 104. A cyan-pigment layer (hereinafter referred to as "C-pigment layer" 108 is provided on the other side of the support. All of these components are transparent. In this connection, the Y-pigment layer 106 is a light fixing type, and has such a nature that light of a wavelength of 400 nm, when applied to the Y-pigment layer 106 from a light source 109, will fix the layer whereby no change subsequently occurs in the Y-pigment layer 106 even if the latter is heated. In case of a thermal recording material, in which a white layer (not shown) is provided on the Y-pigment layer 106, the image can be viewed as a reflective image from the side of the C-pigment layer 108. A recording head 110 is arranged above the thermal recording material 10.

First, in FIG. 4(A), the Y-pigment layer 106 is heat-processed by the thermal head 110. In this case, the heat quantity applied to the M-pigment layer 104 beneath the Y-pigment layer 106 is such that the M-pigment layer 104 is not developed in color by the heat quantity. By doing so, only the Y-pigment layer 106 is developed in color.

Subsequently, in FIG. 4(B), light whose wavelength is of the order of 400 nm, is applied from the side of the Y-pigment layer 106. Thus, the Y-pigment layer 106 is fixed, and no change in color occurs at subsequent heating.

In FIG. 4(C), the M-pigment layer 104 is heat-processed by a heat quantity that is larger than that at the time the Y-pigment layer 106 is heated. By doing so, the M-pigment layer 104 is developed in color.

Subsequently, in FIG. 4(D), the thermal recording material 10 is reversed. In FIG. 4(E), the C-pigment layer 108 is heated-processed. Further, in the case where another recording head 112 as indicated by the double dotted lines in FIG. 4(A) is arranged beneath the thermal recording material 10, the C-pigment layer 108 is heat-processed under a condition that the C-pigment layer 108 remains intact. In this case, the C-pigment layer 108 is heated by such a heat quantity that no influence is exerted on the M-pigment layer 104 which cooperates with the C-pigment layer 108 to clamp therebetween the PET 102. Thus, the C-pigment layer 108 is developed in color.

However, a condition for obtaining an image recording apparatus which records an image onto multi-color thermal recording material is that, since the same image is recorded divided into three steps to reproduce the color of the image, it is necessary that the thermal recording material is accurately positioned. As far as accurate positioning cannot be automatically processed, it becomes difficult to process the multi-color thermal recording material at high speed as in the conventional image recording apparatus. Further, as shown in FIG. 4(A), if the recording heads 110 and 112 are arranged respectively on the both sides of the thermal recording material 10, the reversing operation of the thermal recording material 10 as shown in FIG. 4(D) is dispensed with. However, The number of component parts increases, and the apparatus per se also increases in size. Thus, this is not preferable.

SUMMARY OF THE INVENTION

It is therefore an object of the invention to provide an image recording apparatus in which each color-developing layer provided respectively on both sides of a transparent support can automatically be heat-processed in a way that the number of component parts decreases, and in which the image recording apparatus is provided with a high-speed processing capability.

According to the present invention, there is provided an image recording apparatus in which a thermal recording material has a transparent support which is provided, on its respective sides, with at least one transparent thermal color-developing layer which is developed in a color different from that of other layers, and the transparent thermal color-developing layers are heated separately and are developed in color to record an image onto the thermal recording material, the image recording apparatus comprising:

a transporting device having a loop-like transport path for transporting the thermal recording material along the transport path in a loop manner;

a reversing device for disengaging the thermal recording material from the transport path and for sending out the disengaged thermal recording material to the transport path, thereby reversing the thermal recording material;

a recording head arranged midway along the transport path and operative at each transportation of the thermal recording material by the transporting means to heat-process one of the corresponding transparent thermal color-developing layers, thereby developing in color the transparent thermal color-developing layer; and a setting device for judging a position, at which the image is to be recorded, on the thermal recording material at each transportation thereof by the transporting means, for setting, the timing of the heat processing by the recording head.

According to the invention constructed as described above, when a thermal recording material is transported along the loop-like transport path, the thermal recording material is guided along the transport path and reaches a position of the recording head. Here, the heating head is operated at the time set by the setting device, to heat-process a first one of the color-developing layers.

The thermal recording material after heat processing is once disengaged from the loop-like transport path, the transport direction is reversed and that the thermal recording material is again conveyed to the loop-like transport path. By doing so, the thermal recording material again reaches the position of the recording head under such a condition that the thermal recording material is reversed. Here, heat processing is conducted with respect to a color developing layer that is different from which described previously in synchronism with the timing set by the timing setting device. Thus, it is possible to heat-process, with single recording head, a thermal recording material in which the color-developing layers are provided respectively on both sides of the transparent support.

In this manner, according to the present invention, since heat processing is performed on the basis of the timing determined by the setting device, no shift or deviation in position occurs so that it is possible to develop the various colors at their respective predetermined positions. Further, since high-speed processing is also possible, practicality is superior so that it is possible to effectively utilize the multi-color thermal recording material. Furthermore, since the transport path is in the form of a loop, it is possible to use a thermal recording material which is lengthened correspondingly to the length of the loop-like transport path. For instance, in a conventional construction in which the thermal recording material is wound about a drum and is heat-processed, it is required, that the outer peripheral diameter of the drum be increased to cope with the long thermal recording material. However, in the above invention, the transport path is formed in a loop configuration so that the apparatus is reduced in size.

According to one aspect of the present invention, the image recording apparatus comprises a applying device for applying a pair of positioning marks respectively to the front of and in rear of the image. Accordingly, if the image is recorded on the basis of these positioning marks, it is possible to record the various color-developing layers reliably and accurately even if the transport direction varies. The mark applying device may be a recording head.

According to another aspect of the invention, the image recording apparatus comprises an end detecting sensor which is arranged upstream of the image recording position. Using the sensor, both ends of the thermal recording material and an image edge are detected. The image recording apparatus further comprises a control device for setting the timing of heat processing for the various color-developing layers on the basis of a distance between ends of the thermal recording material and the image edge and the transport speed. Thus, it is unnecessary to apply the aforesaid positioning marks onto the thermal recording material.

According to still another aspect of the present invention, the image recording apparatus comprises an end detecting sensor which is arranged downstream of the image recording position. With the sensor, both ends of the thermal recording material and an image edge are detected. The image recording apparatus further comprises a control device for setting timing of heat processing for the various color-developing layers on the basis of the distance between both ends of the thermal recording material and the image edge and the transport speed. Accordingly, it is unnecessary to apply positioning marks onto the thermal recording material.

According to another aspect of the present invention, a positioning mark is applied to a section of the thermal recording material between an end thereof and the image edge which is blank at a trailing edge of the thermal recording material in the transporting direction at the recording of the first color-developing layer on the thermal recording material. The position of the positioning mark is used such that the distance from the image edge is in agreement with the distance from the leading edge of the thermal recording material in the transport direction to the image edge. Here, in case the transport direction of the thermal recording material is reversed, if recording of the image starts after a predetermined period of time from detection of the positioning mark by the positioning mark detecting sensor, recording of the image can be done under control which is the same as that before the transport direction is reversed.

DETAILED DESCRIPTION

Figure 1:
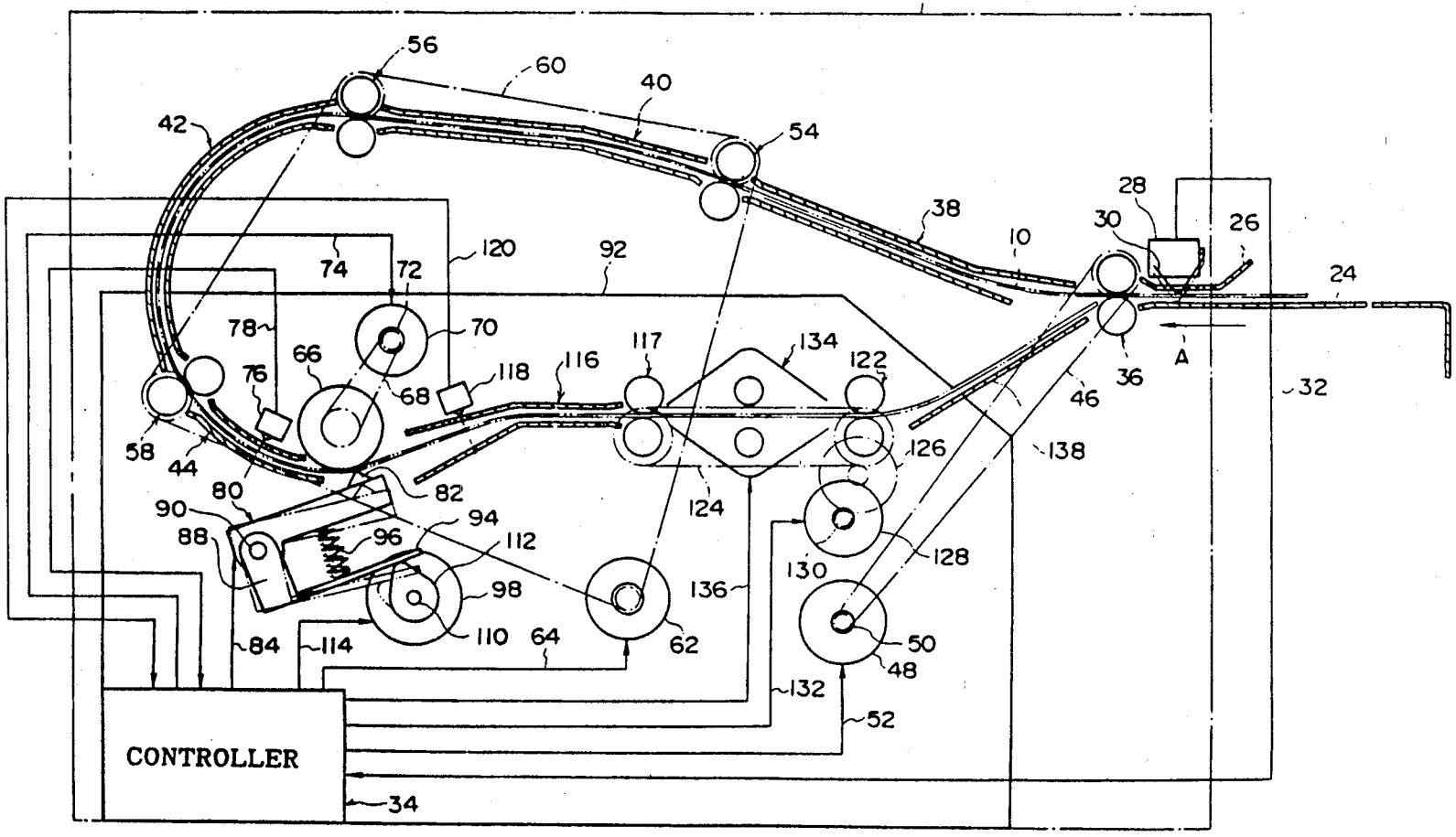
FIG. 1 is a schematic constructional view of an image recording apparatus according to an embodiment of the present invention.

Referring to FIG. 1, there is shown a schematic construction of an image recording apparatus according to a first embodiment of the present invention.

A resting table 24 for a thermal recording material 10 projects from the right-hand side surface of the casing 20 as viewed in FIG. 1. Thermal recording material 10 rests on the resting table 24. A leading edge of the recording material 10 is inserted into the casing 20 and conveyed in the direction indicated by A in FIG. 1.

As indicated in the section on prior art, the thermal recording material 10 is constructed in a manner in which two color-developing layers (M and Y) 104 and 106 and a color-developing layer (C) 108 are provided respectively on either side of a support (see FIGS. 4(A) through 4(E)). In this connection, in the embodiment, a PET sheet 102 is used as the support, and the thermal recording material 10 is transparent as a whole.

A microswitch 28 is arranged, through a guide plate 26, downstream of the resiting table 24 in the transport direction of the thermal recording material 10. The microswitch 28 has a contactor 30 which interferes with the transport path of the thermal recording material 10. The contactor 30 is generally in the form of V, and can switch a contact within the microswitch 28 by passage of the thermal recording material 10 regardless of the transport direction. The contactor 30 turns on the contact within the microswitch 28 when the thermal recording material 10 is detected, while the contactor 30 turns off the contact when the thermal recording material 10 is not detected. A signal line 32 from the microswitch 28 is connected to a controller 34.

The thermal recording material 10, which has passed through the microswitch 28 from the right-hand side as viewed in FIG. 1, is clamped between a first pair of transport rollers 36, and guided along pairs of guide plates 38, 40, 42 and 44. Each pair of guide plates are provided to correspond to front and rear sides of the thermal recording material 10. The thermal recording material 10 is conveyed generally in the form of C by the pairs of a guide plates 38, 40, 42 and 44. This transport path constitutes a part of a loop-like transport path.

The first pair of transport rollers 36 are connected to a rotary shaft 50 of a motor 48 through a drive belt 46. A signal line 52 from the motor 48 is connected to the controller 34 so that the motor 48 is rotated in normal and reverse directions.

A second pair of transport rollers 54 are arranged between the pairs of guide plates 38 and 40. A third pair of transport rollers 56 is arranged between the pairs of guide plates 40 and 42. A fourth pair of transport rollers 58 is arranged between the pairs of guide plates 42 and 44. These pairs of transport rollers 54, 56 and 58 are connected to a rotary shaft of a motor 62 through a drive belt 60. A signal line 64 from the motor 62 is connected to the controller 34. The motor 62 is rotated in one direction, that is, in the clockwise direction as viewed in FIG. 1, in response to a signal from the controller 34.

At the leading edge of the thermal recording material 10 in the transport direction at the pair of guide plates 42, a platen roller 66 is arranged to one side of the thermal recording material 10. The platen roller 66 is connected to a rotary shaft 72 of a motor 70 through a drive belt 68. A signal line 74 from the motor 70 is connected to the controller 34 so that the motor 70 is rotated in one direction.

A first photoelectric sensor 76 is arranged between the fourth pair of transport rollers 58 and the platen roller 66. The first photoelectric sensor 76 is of a reflective type, and has a contact which is switched on the basis of the presence of the thermal recording material 10. That is, the first photoelectric sensor 76 is turned on when the thermal recording material 10 is detected and turned off when the thermal recording material 10 is not detected. A signal line 78 from the first photoelectric sensor 76 is connected to the controller 34.

Further, a line-type thermal head 80 serving as a recording head is arranged on the other side of the thermal recording material 10, corresponding to the platen roller 66. The thermal head 80 has a heating element 82 mounted on one end. At a given time, an image signal is supplied from the controller 34 through a signal line 84. The heating element 82 then generates heat correspondingly to the image signal, to heat the thermal recording material 10.

Figure 2:
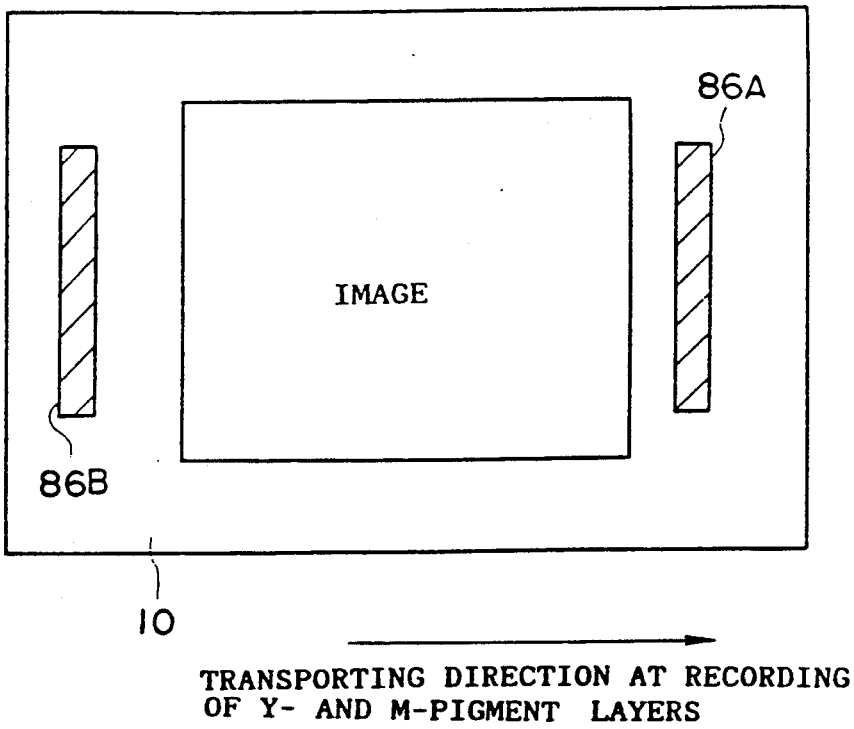
FIG. 2 is a top plan view of a thermal recording material.

Moreover, positioning signals are also outputted to the thermal head 80 from the controller 34. The positioning signals are outputted respectively before and after the image signal when the first pigment layer, the Y-pigment layer 106 in this embodiment, is heated and recorded, so that a pair of positioning lines 86A and 86B each in the form of a bar as shown in FIG. 2 are recorded. In this connection, the positioning line 86A before the image signal is formed after a predetermined period of time from the point of time the leading edge of the thermal recording material 10 is detected by the first photoelectric sensor 76, while the positioning line 86B after the image signal is formed after a lapse of a predetermined period of time after completion of output of the image signal. On the basis of the positioning lines 86A and 86B, the recording period for recording the other pigment layers is determined.

The thermal head 80 is rotatably supported so as to be angularly movable a predetermined angle about a shaft 90 with respect to a bracket 88. The thermal head 80 and the bracket 88 are rotatably supported on an apparatus frame 92 through the shaft 90. The bracket 88 is formed with a tongue 94 which extends in parallel relation to the thermal head 80. A compression coil 96 is interposed between the tongue 94 and the thermal head 80. By a biasing force of the compression spring 96, the thermal head 80 is biased toward the platen roller 66 about the shaft 90. On the other hand, the bracket 88 is biased away from the platen roller 66 about the shaft 90 by a biasing force of biasing means (not shown). In the direction of the biasing force away from the platen roller 66, a cam 112 is arranged which is mounted on a rotary shaft 110 of a motor 98. The bracket 88 is supported by the cam 112. A signal line 114 from the motor 98 is connected to the controller 34 such that the motor 98 is rotated in normal and reverse directions in response to a signal from the controller 34.

When the cam 112 is in the position indicated by the solid lines as in FIG. 1, the bracket 88 and the thermal head 80 are also in their respective positions indicated by the solid lines so that the thermal recording material 10 is clamped between the thermal head 80 and the platen roller 66. Further, when the cam 112 is in the position indicated by the dotted lines as in FIG. 1, the thermal head 80 is spaced away from the platen roller 66 so that a gap occurs between the thermal head 80 and the platen roller 66.

A pair of guide plates 116 are arranged downstream of the platen roller 66, for guiding the front and rear sides of the thermal recording material 10. The thermal recording material 10 is guided by the pair of guide plates 116 and reaches a fifth pair of transport rollers 117, and is clampled therebetween. A second photoelectric sensor 118 is arranged above the pair of guide plates 116. The second photoelectric sensor 118 serves to detect the aforesaid positioning lines 86A and 86B, and is connected to the controller 34 through a signal line 120.

The fifth pair of transport rollers 117 are connected, through a drive belt 124, to a sixth pair of transport rollers 122 arranged downstream of the fifth pair of transport rollers 117. The sixth pair of transport rollers 122 are connected to a rotary shaft 130 of a motor 128 through a gear 126. A signal line 132 from the motor 128 is connected to the controller 34 such that the motor 128 is rotated in one direction in response to a signal from the controller 34.

A pair of light sources 134 are arranged between the fifth pair of transport rollers 117 and the sixth pair of transport rollers 122 corresponding respectively to the front and rear sides of the thermal recording material 10. The pair of light sources 134 are connected to the controller 34 through a signal line 136 such that the pair of light sources 134 are turned on and off in response to a signal from the controller 34.

Light applied from the pair of light sources 134 has a wavelength of 400 nm, and serves to fix the Y-pigment layer 106 on the thermal recording material 10.

A guide plate 138 is arranged downstream of the sixth pair of transport rollers 122. The guide plate 138 has a forward end which extends to the vicinity of the first pair of transport rollers 36. The guide plate 138 cooperates with the pair of guide plates 116 and the C-shaped transport path to define the loop-like transport path. Here, by reverse rotation of the first pair of transport rollers 36, the thermal recording material 10 guided and transported by the guide plate 138 is clamped and disengaged from the loop-like transport path. Thus, the thermal recording material 10 is conveyed onto the resting table 24. In this connection, when the thermal recording material 10 is conveyed onto the resting table 24, the contact of the microswitch 24 is switched by the leading edge of the thermal recording material 10. The controller 34 alters the rotational direction of the first pair of transport rollers 36 to a normal direction after a lapse of a predetermined period of time after the switching of the contact of the microswitch 28, whereby the thermal recording material 10 is again fed into the loop-like transport path. Thus, the thermal recording material 10 is guided toward the second pair of transport rollers 54.

The operation of the embodiment will hereunder be described with reference to a control flow chart in FIG. 3.

First, at step 200, a flag F is reset to (0) and variable N is cleared. Subsequently, the program proceeds to step 202 where it is judged whether or not the flag F is set. Here, since, at an initial stage, the flag F is reset, the case where judgment is affirmative will first be described.

When the judgment is affirmative at step 202, the program proceeds to step 204 where it is judged whether or not the microswitch 28 is turned on. That is, the thermal recording material 10 rests on the resting table 24, and the leading edge of the thermal recording material 10 is inserted into the casing 20, whereby the contactor 30 is moved as indicated by the solid lines in FIG. 1 so that the image recording apparatus is turned on. When the microswitch 28 is turned on, the program proceeds to step 206 where the pair of light sources 134 are turned on. Subsequently, at step 208, the motor 48 is rotated in the normal direction, and the motors 62 and 70 are driven. Subsequently, the program proceeds to step 210. Here, the thermal recording material 10 is guided into the loop-like transport path which is constituted by the pairs of guide plates 38, 40, 42 and 44 and so on, so that the thermal recording material 10 is conveyed to the platen roller 66. Under this condition, the thermal head 80 is spaced away from the platen roller 66 as indicated by the double dotted lines in FIG. 1.

At step 210, it is judged whether or not the first photoelectric sensor 76 is turned on. By turning-on the first photoelectric sensor 76, it is possible to detected the leading edge of the thermal recording material 10. The thermal recording material 10 reaches the platen roller 66 after a lapse of a predetermined period of time from the detection of the leading edge of the thermal recording material 10 (step 212).

At subsequent step 214, the motor 98 is driven to angularly move the cam 112 in the clockwise direction as viewed in FIG. 1. By the driving of the cam 112, the tongue 46 is pushed up so that the bracket 88 is angularly moved about the shaft 90. Thus, it is possible to clamp the thermal recording material 10 between the heating element 82 of the thermal head 80 and the platen roller 66. Here, since the thermal head 80 is biased by the compression spring 96, it is possible to clamp the thermal recording material 10 under substantially constant force.

At step 216, the forward positioning signal is outputted before outputting of the image signal, and the forward positioning line 86A is written. Subsequently, the program proceeds to step 218 where the image signal of the Y-pigment layer 106 is outputted. Subsequently, at step 220, the rearward positioning signal is outputted so that the rearward positioning line 86B is written. In this connection, since the heat quantity of the heating element 82 by means of the image signal of the Y-pigment layer 106 is set to "weak", no influence is exerted on the lower M-pigment layer 104.

When predetermined writing is completed at steps 216, 218 and 220, the program proceeds to step 222 where the motor 98 is driven to angularly move the cam 112 in the counterclokwise direction as viewed in FIG. 1. Thus, the thermal head 80 retreats so that clamping of the thermal recording material 10 by the thermal head 80 and the platen roller 66 is released.

Subsequently, the thermal recording material 10 is guided by the pair of guide plates 116, and is clamped between and transported by the fifth and sixth pairs of transport rollers 117 and 122. Between the fifth pair of transport rollers 117 and the sixth pair of transport rollers 122, the Y-pigment layer 106 is fix-processed by the light from the pair of light sources 134. The thermal recording material 10 after being fix-processed is guided by the guide plate 138, and conveyed toward the first pair of transport rollers 36.

Figure 3A:
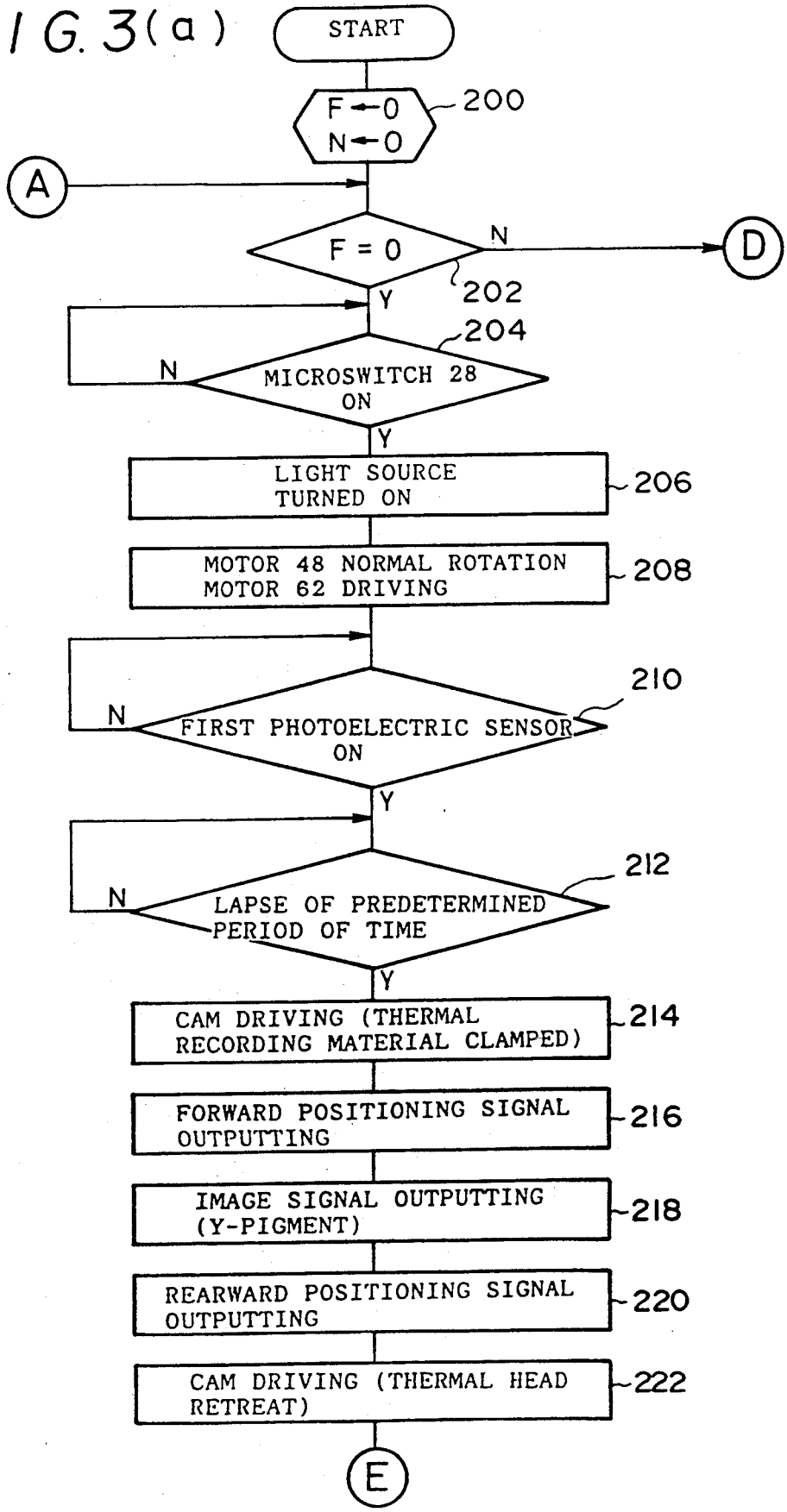
FIGS. 3(*a*) through 3(*d*) are control flow charts.
Figure 3B:
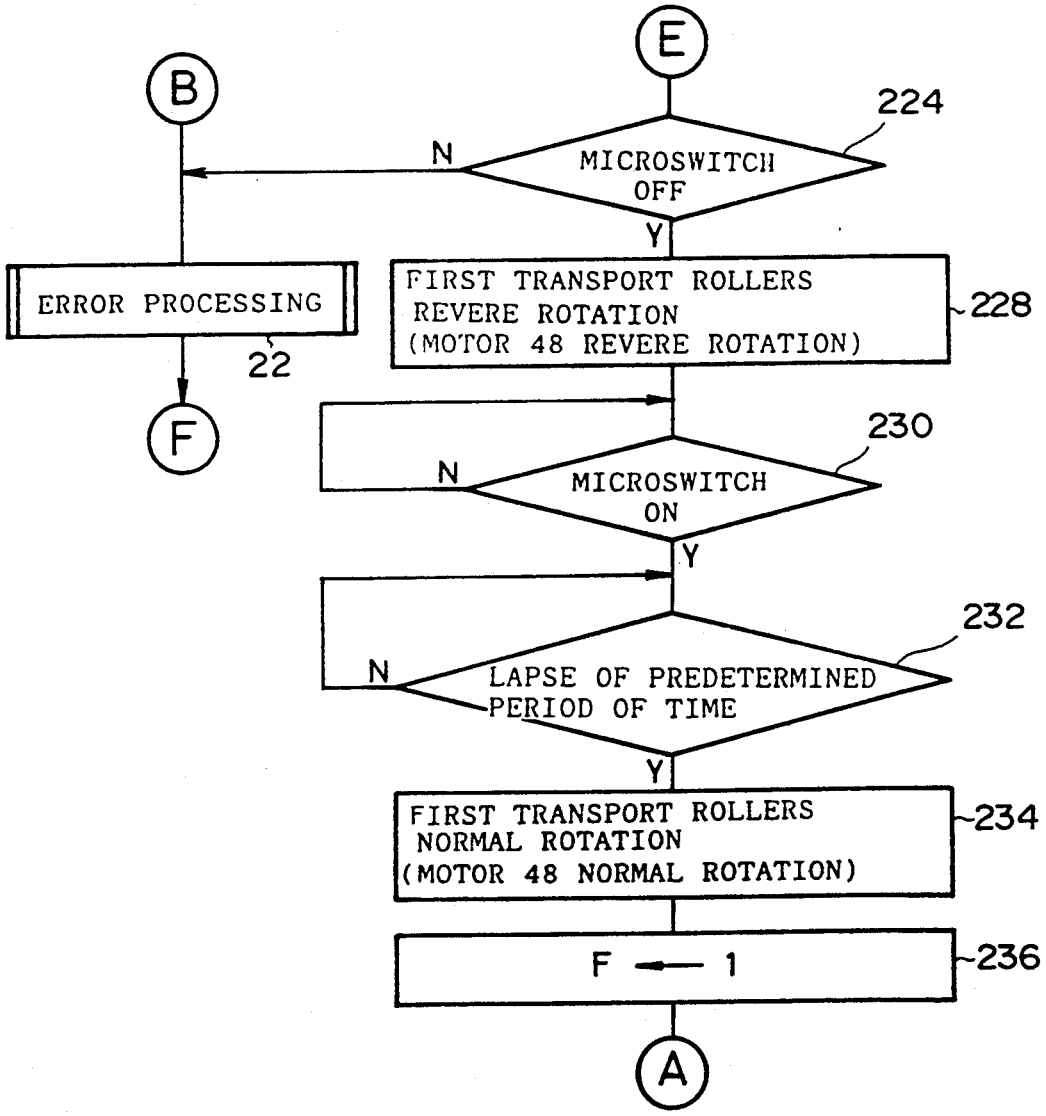
Figure 3C:
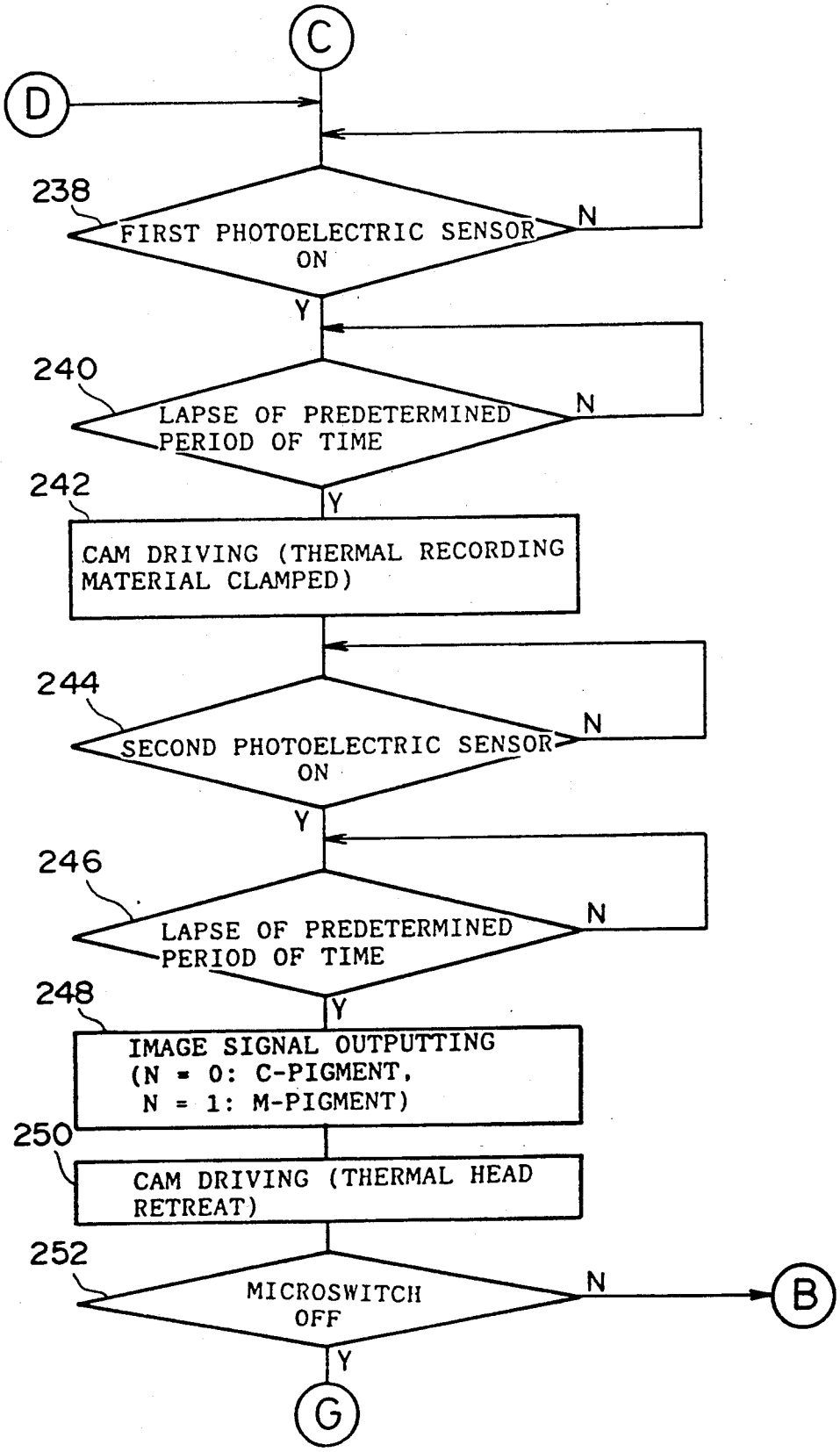
Figure 3D:
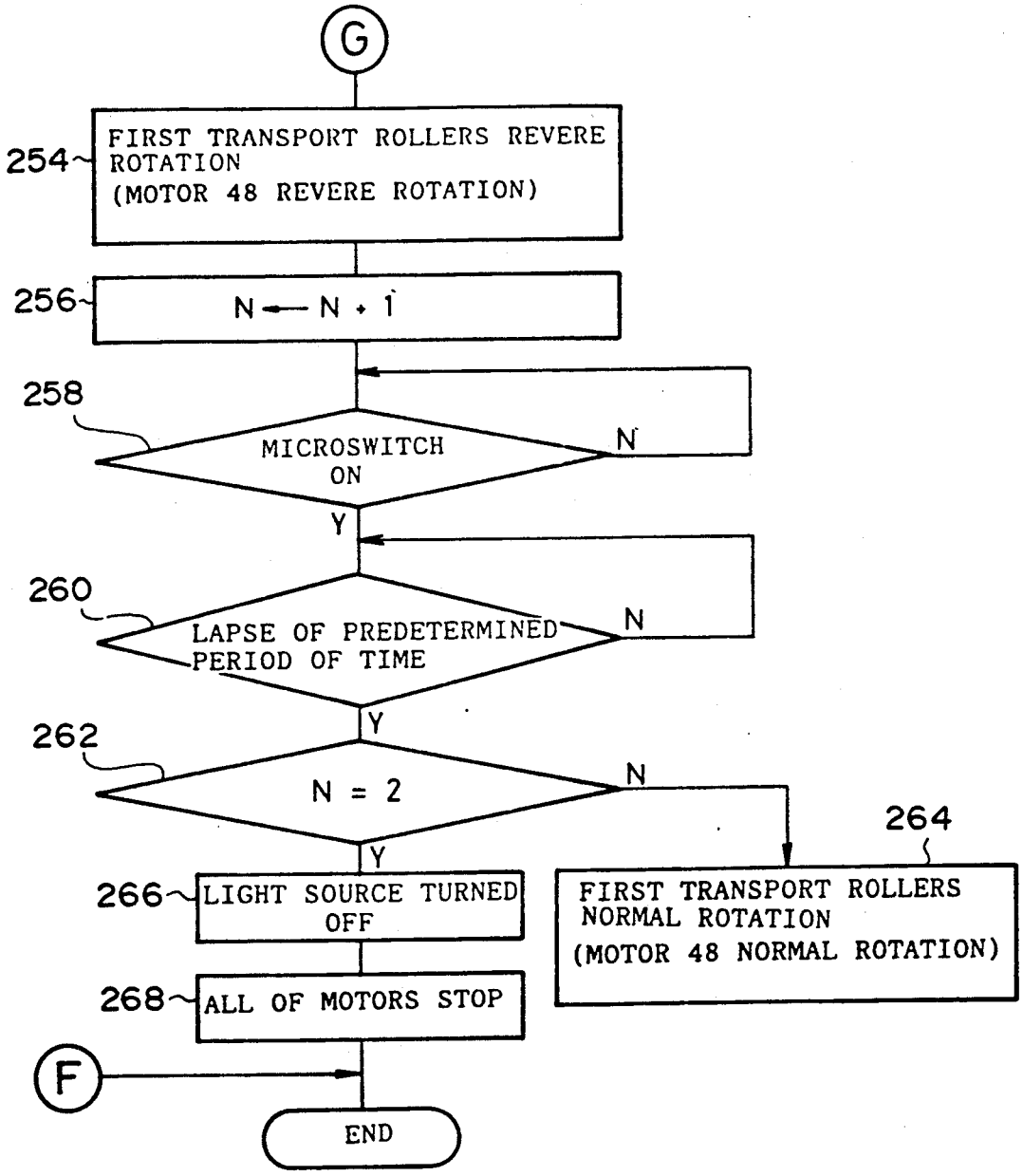
Figure 4:
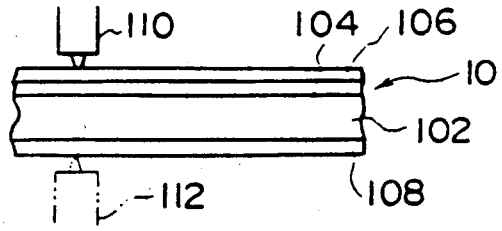
FIGS. 4(A) through 4(E) are views for explanation of a color-developing step of a multi-color thermal recording material which is applied to the present invention.
Figure 4:
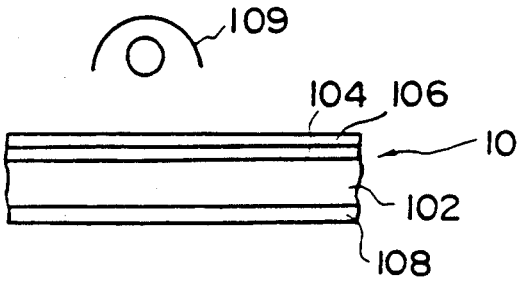
Figure 4:
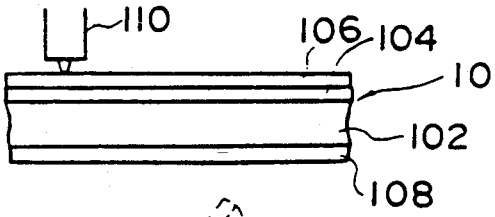
Figure 4:
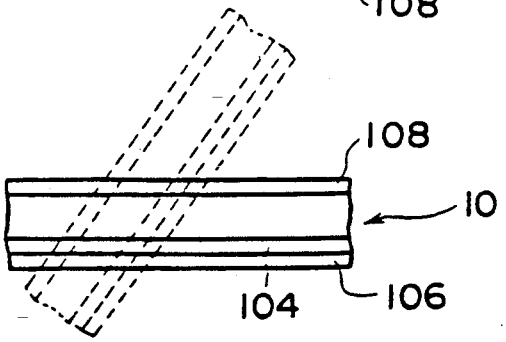
Figure 4:
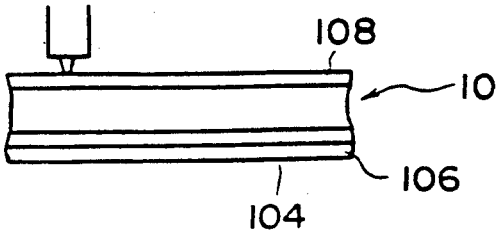

In the meantime, at step 224, it is judged whether or not the microswitch 28 is turned off (see FIG. 3*b*). If judgment is affirmative, the program proceeds to step 228 where the first pair of transport rollers 36 are rotated in the reverse direction. Here, when the microswitch 28 is turned on, the longitudinal size of the thermal recording material 10 in the transport direction is longer than the loop-like transport path, indicating a problem. Thus, the program proceeds to step 226 where error processing such as the forcible feeding-out of the thermal recording material 10 and so on, is performed and, subsequently, the program is completed.

When the thermal recording material 10 reaches the pair of transport rollers 36 under the condition that the first pair of transport rollers 36 are rotated in the reverse direction at step 228, the first pair of transport rollers 36 feed out the thermal recording material 10 onto the resting table 24. Here, at step 230, after a lapse of a predetermined period of time from a point in time the microswitch 28 is turned on at step 232, the first pair of transport rollers 36 are rotated in the normal direction at step 234.

Subsequently, the flag F is set to (1) at step 236, and the program proceeds to step 202. The predetermined period of time indicated in step 232 is determined so that the vicinity of the trailing edge of the thermal recording material 10 is clamped between the first pair of transport rollers 36. Under this condition, the first pair of transport rollers 36 are rotated in the normal direction, whereby the thermal recording material 10 is reversed. Further, under the condition that the transport direction is reversed, the thermal recording material 10 is again guided toward the pair of guide plates 38.

Where step 202 indicates a negative judgment, that is, where the image recording on the Y-pigment layer 106 has been completed, the program proceeds to step 238 where the leading edge of the thermal recording material 10 is detected by the first photoelectric sensor 76. Subsequently, after a predetermined period of time (step 240), the program proceeds to step 242. At step 242, the cam 112 is driven to clamp the thermal recording material 10 between the thermal head 80 and the platen roller 66. At step 244, it is judged whether or not the positioning line 86A or 86B is detected on the basis of the ON and OFF conditions of the second photoelectric sensor 118. In this connection, in the case immediately after the image recording of the Y-pigment layer 106, the transport direction of the thermal recording material 10 is reversed. Thus, the positioning line 86B is detected.

When the positioning line 86A or 86B is detected at step 244, a lapse of a predetermined period of time is awaited at step 246, and the program proceeds to step 248 where the image signal is outputted to record the image. The cam 112 is driven, that is, the thermal head 80 retreats at step 250. In this case, the heat quantity of the heating element 82 is set to "strong". Here, where the variable N is 0 (zero), recording is performed with respect to the C-pigment layer 108, while, in case N is 1, recording is conducted with respect to the M-pigment layer 104. In this connection, in case of image recording with respect to the C-pigment layer 108, the recording direction is reversed with respect to the image recording on the Y-pigment layer 106.

At subsequent step 252, it is judged whether or not the microswitch 28 is turned off. When the microswitch 28 is turned on, the program proceeds to step 226, similarly to step 224, where error processing is performed. When the microswitch 28 is turned off, the first pair of transport rollers 36 are reversed in their rotation at step 254. Subsequently, at step 256, the variable N increases incrementally.

At subsequent step 258, the microswitch 28 is turned on. At a point of time when a predetermined period of time has elapsed at step 260, that is, at a point of time when the thermal recording material 10 is positioned for clamping by the first pair of transport rollers 36, the program proceeds to step 262 where it is judged whether or not the variable N is 2. When judgement is negative, the thermal recording material 10 is again reversed, and the transport direction is reversed. Thus, it is judged that the image recording must be performed with respect to the M-pigment layer 104, and the program proceeds to step 264 where the first pair of transport rollers 36 are rotated in the normal direction and, subsequently, the program proceeds to step 238. Further, when judgement in step 262 is affirmative, it is judged that the image recording with respect to the M-pigment layer 104 has been completed. Thus, the thermal recording material 10 is discharged onto the resting table 24, and the program proceeds to step 266 where the pair of light sources 134 are turned off. Subsequently, the motors 48, 62 and 70 stop their operation at step 268 so that image recording is completed.

A second embodiment of the invention will next be described. The image recording apparatus according to the second embodiment is the same in construction as that according to the first embodiment. The description of the construction will therefore be omitted.

A characteristic of the second embodiment resides in that positioning lines 86A and 86B are not recorded, and positioning is done on the basis of the size of the thermal recording material 10 from its ends to an image edge portion.

Figure 5:
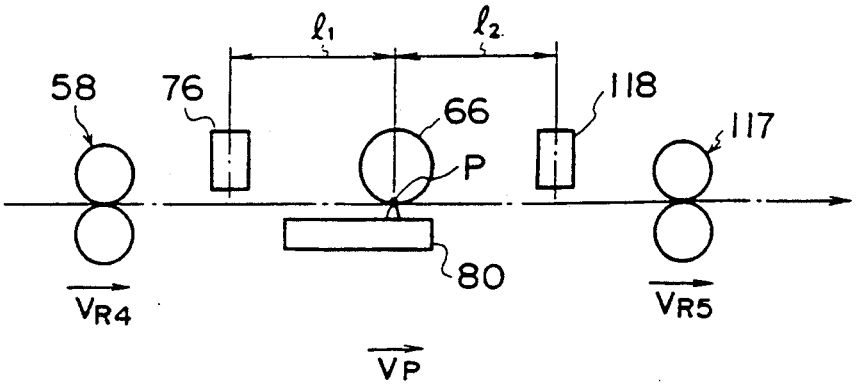
FIG. 5 is a schematic view of the vicinity of an image recording position for explanation of the second, third and fourth embodiments of the present invention.

As shown in FIG. 5, it is assumed that a distance from the clamping point of the thermal recording material 10 by means of the platen roller 66 and the thermal head 80, that is, from a recording point P to the first photoelectric sensor 76 is $l_1$, and a distance from the recording point P to the second photoelectric sensor 118 is $l_2$. Further, it is assumed that the transport speed of the thermal recording material 10 by the fourth pair of transport rollers 58 is $V_{R4}$, that the transport speed of the thermal recording material 10 by the fifth pair of transport rollers 117 is $V_{R5}$, and the transporting speed of the thermal recording material 10 by the platen roller 66 is $V_P$. These speeds $V_{R4}$, $V_{R5}$ and $V_P$ are stored in a memory of the controller 34.

Figure 6:
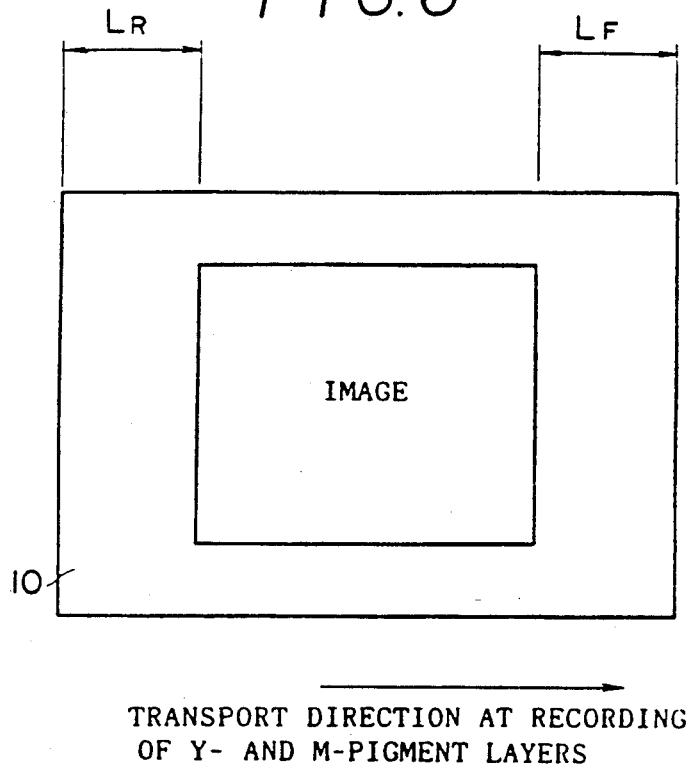
FIG. 6 is a top plan view of a thermal recording material according to the second embodiment.

Here, at initial image recording, that is, at recording of the Y-pigment layer 106, the time from detection of the leading edge of the thermal recording material 10 by means of the first photoelectric sensor 76 to the start of the image recording is assumed to be $t_1$, and is stored. By doing so, as shown in FIG. 6, a blank or a space $L_F$ at the leading edge of the Y-pigment layer 106 at recording in the transport direction can be obtained on the basis of the following equation:

$$L_F = V_{R4} \times t_1 - l_1 \quad (1)$$

Further, the time after image recording of the Y-pigment layer 106 to the detection of the trailing edge of the thermal recording material 10 in the transport direction by means of the first photoelectric sensor 76 is assumed to be $t_2$, and is stored. Thus, a blank or a space $L_R$ of the Y-pigment layer 106 at recording in the transport direction can be obtained by the following equation:

$$L_R = l_1 - V_P \times t_2 \quad (2)$$

Figure 7:
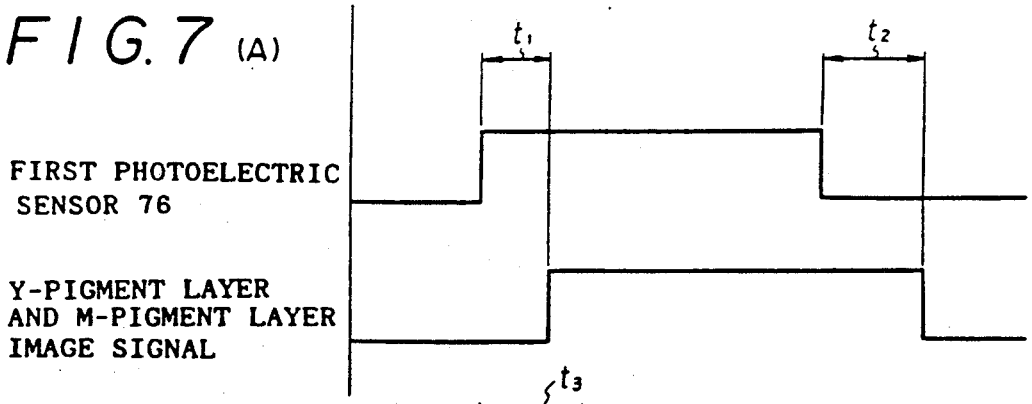
FIGS. 7(*a*) and 7(*b*) is a time chart for explanation of a positioning procedure according to the second embodiment.
Figure 7:
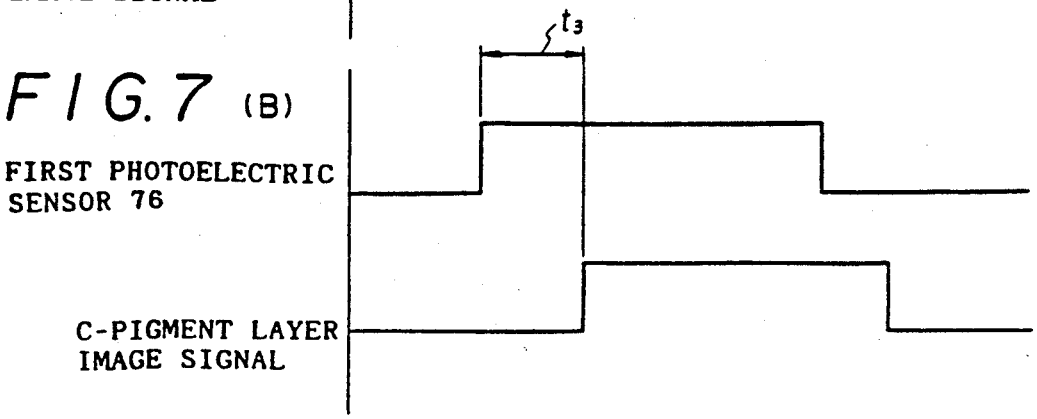

From the above equations (1) and (2), as shown in FIG. 7, the time $t_3$ from the detection of the leading edge of the thermal recording material 10 by the first photoelectric sensor 76 at image recording of the subsequent C-pigment layer 108 to the start of the image recording can be obtained by the following equation:

$$V_{R4} \times t_3 - l_1 = l_1 - V_P \times t_2 \quad (3)$$

From equation (3), $$t_3 = (2 \times l_1 - V_P \times t_2)/V_{R4} \quad (4)$$

Here, since $V_{R4} \approx V_P$, $$t_3 = (2 \times l_1/V_{R4}) - t_2 \quad (5)$$

Further, at recording of the M-pigment layer 104, the leading edge of the thermal recording material 10 in the transport direction should be detected by the first photoelectric sensor 76 and, subsequently, the image should begin to be recorded after the time $t_1$.

In the second embodiment, since the positioning lines 86A and 86B are dispensed with, the image recording speed becomes fast, and unnecessary lines do not enter the blank.

In a third embodiment, the second photoelectric sensor 118 is used to perform positioning. The image recording apparatus according to the third embodiment is similar in construction to that according to the first embodiment, and the description of the construction will be omitted.

As shown in FIG. 5, it is assumed that a distance from the clamping point of the thermal recording material 10 by the platen roller 66 and the thermal head 80, that is, from the recording point P to the second photoelectric sensor 118 is $l_2$. Further, it is assumed that the transport speed of the thermal recording material 10 by the fifth pair of transport rollers 117 is $V_{R5}$, and the transport speed of the thermal recording material 10 by the platen roller 66 is $V_P$. These speeds $V_{R5}$ and $V_P$ are stored in the memory of the controller 34.

Figure 8:
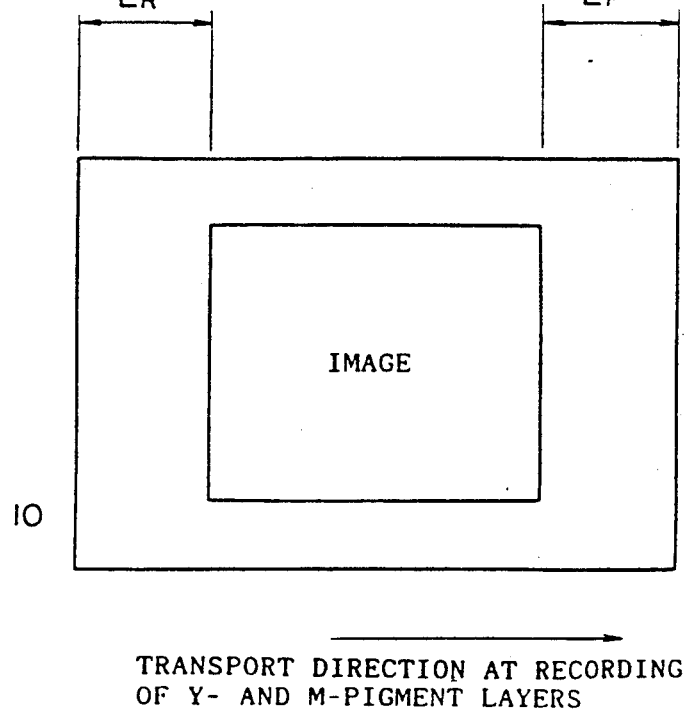
FIG. 8 is a top plan view of a thermal recording material according to the third embodiment.

In the third embodiment, the image recording of the Y-pigment layer 106 is done immediately after detection of the leading edge of the thermal recording material 10 by means of the second photoelectric sensor 118. By doing so, as shown in FIG. 8, a blank $L_F$ at the leading edge of the Y-pigment layer 106 in the thermal recording material 10 at recording in the transport direction becomes $l_2$.

$$L_F = l_2 \quad (6)$$

Further, if the trailing edge of the thermal recording material 10 in the transport direction is detected by means of the second photoelectric sensor 118 at time $t_4$ after image recording of the Y-pigment layer 106 on the thermal recording material 10, a blank $L_R$ at the trailing edge of the thermal recording material 10 can be obtained by the following equation:

$$L_R \times t_4 - l_2 \quad (7)$$

Figure 9:
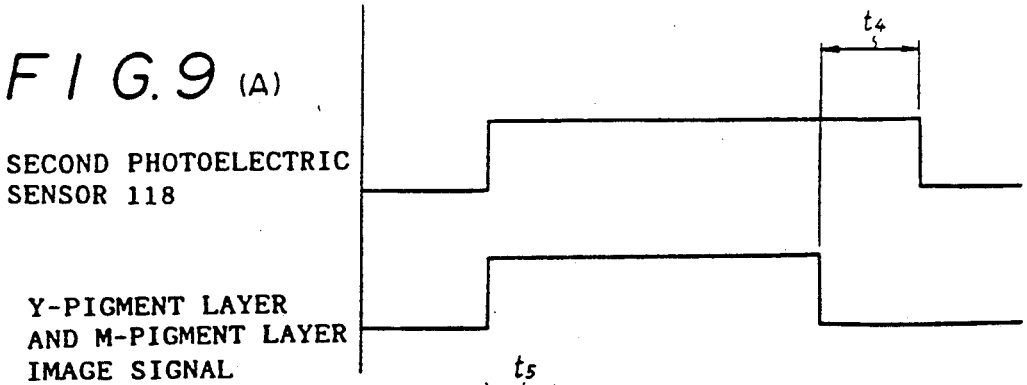
FIGS. 9(*a*) and 9(*b*) is a time chart for explanation of a positioning procedure according to the third embodiment.
Figure 9:
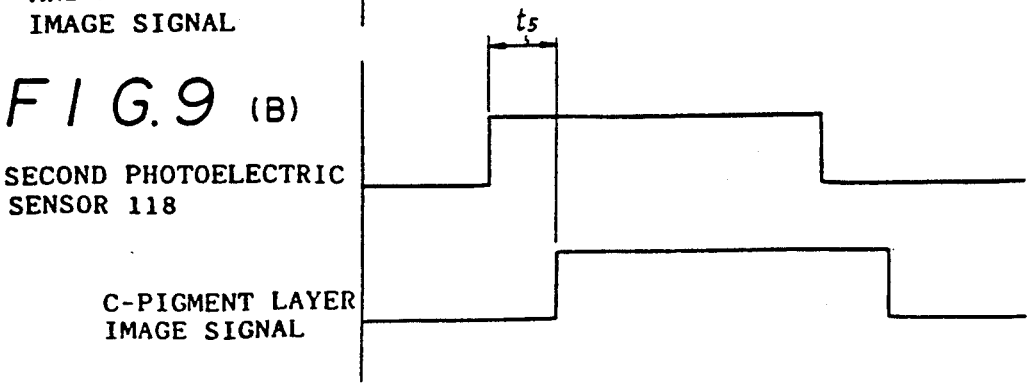

From the above equations (6) and (7), as shown in FIG. 9, the time $t_5$ from detection of the leading edge of the thermal recording material 10 by the second photoelectric sensor 118 at image recording of the subsequent C-pigment layer 108 to the start of image recording can be obtained by the following equation:

$$V_P \times t_5 + l_2 = V_P \times t_4 - l_2 \quad (8)$$

From equation (8), $$t_5 = (V_P \times t_4 - 2 \times l_2)V_P = t_4 - (2 \times l_2/V_P) \quad (9)$$

Further, since $V_P \approx V_{R5}$, $$t_5 = t_4 - (2 \times l_2/V_{R5}) \quad (10)$$

Recording of the M-pigment layer 104 should be done immediately after detection of the leading edge of the thermal recording material 10 in the transport direction by means of the second photoelectric sensor 118.

In this manner, since the positioning lines 86A and 86B are dispensed with, the image recording speed becomes fast, and unnecessary lines do not enter the blank. Further, since only the second photoelectric sensor 118 is positioning, the positioning accuracy can be raised as compared with the combined use of the first and second photoelectric sensors 76 and 118.

A fourth embodiment of the present invention will next be described below.

The fourth embodiment is such that the second photoelectric sensor 118 and the rearward positioning line 86B on the Y-pigment layer 86B at recording in the transport direction are used to perform positioning. An image recording apparatus according to the fourth embodiment is similar in construction to that according to the first embodiment, and the description of the construction will be omitted.

Figure 10:
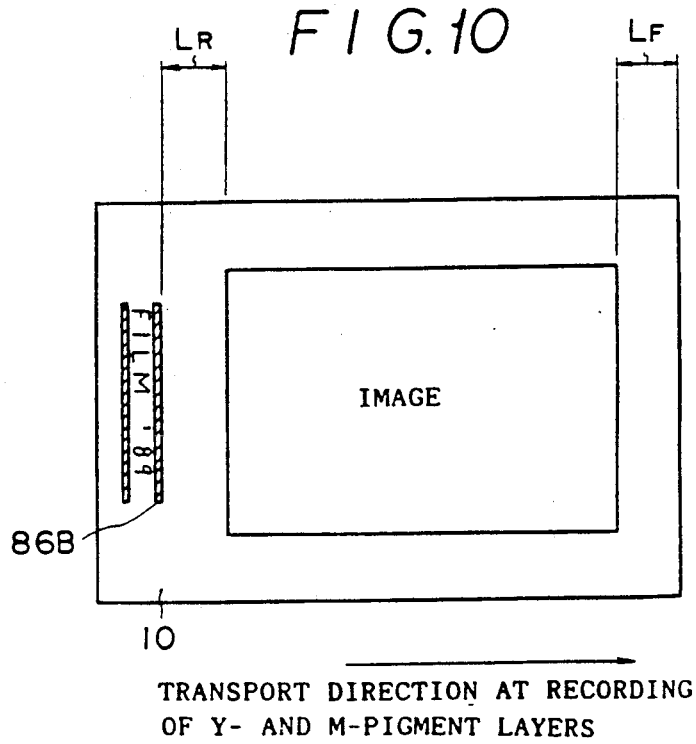
FIG. 10 is a top plan view of a thermal recording material according to the fourth embodiment of the invention.

As shown in FIG. 5, in the fourth embodiment, the image recording of the Y-pigment layer 106 is conducted immediately after detection of the leading edge of the thermal recording material 10 by the second photoelectric sensor 118. By doing so, as shown in FIG. 10, a blank $L_F$ at the leading edge of the Y-pigment layer 106 in the thermal recording material 10 at recording in the transport direction becomes $l_2$.

$$L_F = l_2 \quad (11)$$

Subsequently, after completion of the recording of the Y-pigment layer 106, the positioning line 86B is recorded after a lapse of time $t_6$. The time $t_6$ is set such that a blank $L_R$ immediately after recording of the Y-pigment layer 106 to the positioning line 86B is in agreement with $l_2$, in relation to the transport speed $V_P$ of the platen roller 66. That is, the time $t_6$ is determined such that the following equation is satisfied:

$$L_R = V_P \times t_6 = l_2 \quad (12)$$

Figure 11:
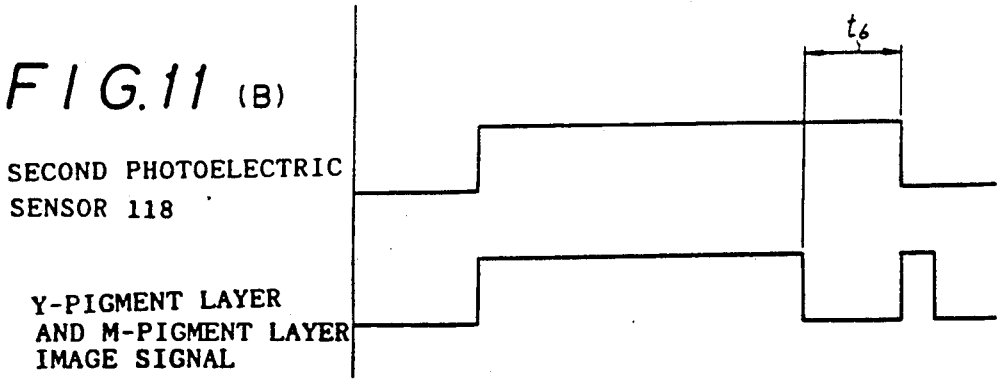
FIGS. 11(*a*) and 11(*b*) is a time chart for explanation of a positioning procedure according to the fourth embodiment of the invention.
Figure 11:
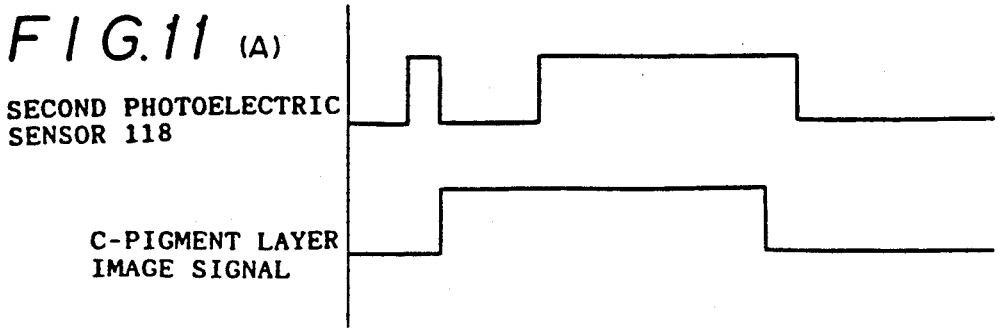

By doing so, as shown in FIG. 11, recording should start immediately after completion of detection of the positioning line 86B at recording of the C-pigment layer 108. Similarly to the second and third embodiments, computation processing becomes unnecessary.

Further, the lack of necessity for computation enables recording to be conducted simultaneously with detection by the second photoelectric sensor 118. Accordingly, even if shrinkage and so on occur in the image, it can be ensured that the thermal recording material 10 is correctly positioned. Thus, positioning accuracy is improved.

In connection with the above, in the first and fourth embodiments, the positioning lines 86A and 86B may not merely be lines, but, for example, as shown in FIG. 10, the positioning line 86B may be data, logo marks, and so on. By doing so, even if there are positioning lines 86A and 86B, there is no feeling of image disorder.

Moreover, in the first through the fourth embodiments, the Y-pigment layer 106 and the M-pigment layer 104 are superimposed upon each other, and the C-pigment layer 108 is provided on the rear side of the thermal recording material 10. However, the Y-pigment layer 106 and the C-pigment layer 108 may be superimposed upon each other.

As described above, the image recording apparatus according to the invention has superior advantages in that it is possible to automatically heat-process each of the color-developing layers which are provided on both sides of the transparent support, number of component parts can be reduced. The image recording apparatus also provides good high-speed processing.

What is claimed is:

1. An image recording apparatus for use with a thermal recording material having a transparent support which is provided, on respective sides thereof, with at least one transparent thermal color-developing layer, said respective layers being developable in respective different colors, and wherein said transparent thermal color-developing layers are separately heated and developed to record an image on the thermal recording material, said image recording apparatus comprising:

transporting means having a loop-like transport path for transporting said thermal recording material in a loop manner;

means for disengaging said thermal recording material from said transport path and subsequently causing said thermal recording material to reenter said transport path in an orientation reversed from that when said material last entered said transport path;

a recording head arranged along said transport path and operative during each transportation of said thermal recording material through said transport path to heatprocess a corresponding transparent thermal color-developing layer, thereby developing in color the transparent thermal color-developing layer; and setting means for judging a position at which said image is to be recorded on said thermal recording material during each transportation thereof through said transport path, for setting timing of the heat processing using said recording head.

2. An image recording apparatus according to claim 1, wherein said setting means includes mark-applying means for applying a pair of positioning marks respectively onto portions of said thermal recording material with respect to the position thereon at which said image is to be recorded, during a first transportation of said thermal recording material through said transport path.

3. An image recording apparatus according to claim 2, wherein said mark-applying means is constituted by said recording head, and wherein said setting means includes control means for operating said recording head to heat front and rear portions of said thermal recording material at locations with respect to the position thereon at which said image is to be recorded thereby applying said pair of positioning marks.

4. An image recording apparatus according to claim 3, wherein said setting means is provided with a positioning-mark detecting sensor for detecting said pair of positioning marks, and wherein said control means judges the position on said thermal recording material, at which said image is to be recorded, on a basis of an output from said positioning-mark detecting sensor during transportation of said thermal recording material through said transport path at and after a second time, to set the timing of the heat processing using said recording head.

5. An image recording apparatus according to claim 1, wherein said setting means comprises an end detection sensor arranged upstream of the position at which said image is to be recorded, for detecting either end of said thermal recording material and control means for setting the timing of said heat processing on the basis of a relationship between a distance between a position of said end detecting sensor and a position of said recording head, and on a basis of a detecting signal from said end detecting sensor, and a transport speed of said thermal recording material.

6. An image recording apparatus according to claim 1, wherein said setting means comprises an end detecting sensor arranged downstream of the position at which said image is to be recorded, for detecting either end of said thermal recording material, and control means for setting the timing of said head processing on a basis of a relationship between a distance between a position of said end detecting sensor and a position of said recording head, and on a basis of a detecting signal from said end detecting sensor, and a transport speed of said thermal recording material.

7. An image recording apparatus according to claim 1, wherein said setting means comprises control means for operating said recording head, after said recording head is operated during a first transportation of said thermal recording material through said transport path, to develop in color one of said transparent thermal color-developing layers, for applying a positioning mark at a position equal to a distance between a leading edge of said thermal recording material and a leading edge of said color-developing layer in a transport direction of said thermal recording material and said color-developing layer.

8. An image recording apparatus according to claim 7, wherein said setting means comprises a detecting sensor for detecting the leading edge of said thermal recording material in the tranport direction, and said positioning mark, and wherein said control means judges the position on said thermal recording material, at which said image is to be recorded, on a basis of a detection signal from said detecting sensor with respect to one of (a) the leading edge of said thermal recording material and (b) said positioning mark, during transportation of said thermal recording material through said transport path, at and after a second time, to set the timing of heat processing using said recording head.

9. An image recording apparatus according to claim 8, wherein said control means conducts said setting such that said recording head is operated immediately after receiving the detection signal from said detecting sensor.

10. An image recording apparatus for use with a thermal recording material in the form of a sheet and having a transparent support which is provided, at respective sides, thereof with at least one transparent thermal color-developing layer, said respective layers being developable in respective different colors, and wherein said transparent thermal color-developing layers are successively separately heated and developed to record a color image on the thermal recording material, said image recording apparatus comprising:

transporting means having a loop-like transport path for transporting said thermal recording material in a loop manner:

means for forming a thermal recording material insertion section with respect to said transport path, including means for dispensing said thermal recording material from said transport path and subsequently reinserting the disengaged thermal recording material into said transport path in an orientation reversed from that when said thermal recording material was last inserted into said transport path;

a recording head arranged along said transport path in facing relation to one side of said thermal recording material and operative at each transportation of said thermal recording material through said transport path to heat-process a corresponding one of said transparent thermal color-developing layers, thereby developing in color the transparent thermal color-developing layer; and setting means for judging a position at which said image is to be recorded on said thermal recording material during each transportation thereof through said transport path, for setting timing of the heat processing using said recording head.

11. An image recording apparatus according to claim 10, wherein said setting means includes mark-applying means for applying a pair of positioning marks on said thermal recording material during a first transportation of said thermal recording material through said transport path.

12. An image recording apparatus according to claim 11, wherein said mark-applying means is constituted by said recording head, and wherein said setting means includes control means for operating said recording head to heat front and rear portions of said thermal recording material with respect to the position thereon at which said image is to be recorded, thereby applying said pair of positioning marks.

13. An image recording apparatus according to claim 12, wherein said setting means is provided with a positioning-mark detecting sensor for detecting said pair of positioning marks, and wherein said control means judges the position on said thermal recording material at which said image is to be recorded on a basis of a detecting signal from said positioning-mark detecting sensor during transportation of said thermal recording material through said transport path at and after a second time, to set the timing of the heat processing using said recording head.

14. An image recording apparatus according to claim 10, wherein said setting means comprises an end detecting sensor arranged upstream, of the position at which said image is to be recorded, for detecting either end of said thermal recording material, and control means for setting the timing of said heating processing on the basis of a relationship between a distance between a position of said end detecting means and a position of said recording head, and on a basis of a detecting signal from said end detecting sensor, and a transport speed of said thermal recording material.

15. An image recording apparatus according to claim 10, wherein said setting means comprises an end detecting sensor arranged downstream, of the position at which said image is to be recorded, for detecting either end of said thermal recording material, and control means for setting the timing of said heat processing on a basis of a relationship between a distance between a position of said end detecting means and a position of said recording head, and on a basis of a detecting signal from said end detecting sensor, and a transport speed of said thermal recording material.

16. An image recording apparatus according to claim 10, wherein said setting means comprises control means for operating said recording head, after said recording head is operated during a first transportation of said thermal recording material through said transport path, to develop in color one of said transparent thermal color-developing layers, for applying a positioning mark at a position equal to a distance between a leading edge of said thermal recording material and a trailing edge of said color-developing layer in a transport direction of said thermal recording material and said color-developing layer.

17. An image recording apparatus according to claim 16, wherein said setting means comprises a detecting sensor for detecting the leading edge of said thermal recording material in the transport direction, and said positioning mark, and wherein said control means judges the position on said thermal recording material at which said image is to be recorded on the basis of a detection signal from said detecting sensor with respect to one of the leading edge of (a) said thermal recording material and said positioning mark, during transportation of said thermal recording material through said transport path at and (b) after a second time, to set the timing of the heat processing due to said recording head.

18. An image recording apparatus according to claim 17, wherein said control means conducts said setting such that said recording head is operated immediately after receiving a detection signal from said detecting sensor.

* * * * *